US007362662B2

(12) United States Patent
Lang

(10) Patent No.: US 7,362,662 B2
(45) Date of Patent: Apr. 22, 2008

(54) COLOR TIMEPIECE

(76) Inventor: Timothy R. Lang, P. O. Box 10001PMB 808, Saipan (MP) 96950

( * ) Notice: Subject to any disclaimer, the term of this patent is extended or adjusted under 35 U.S.C. 154(b) by 626 days.

(21) Appl. No.: 10/633,737

(22) Filed: Aug. 4, 2003

(65) Prior Publication Data

US 2005/0041536 A1 Feb. 24, 2005

(51) Int. Cl.
*G04B 19/06* (2006.01)
*G04B 19/16* (2006.01)

(52) U.S. Cl. ..... 368/232; 368/228

(58) Field of Classification Search ..... 368/76, 368/79, 82, 84, 223, 228, 231, 232, 239, 368/242

See application file for complete search history.

(56) References Cited

U.S. PATENT DOCUMENTS 2,243,343 A * 5/1941 Johnson ..... 368/222
3,616,643 A * 11/1971 Maue ..... 368/229
4,702,615 A * 10/1987 Havel ..... 368/82
4,707,141 A * 11/1987 Havel ..... 368/11
5,214,624 A * 5/1993 Siebrasse ..... 368/82
5,526,327 A * 6/1996 Cordova, Jr. ..... 368/82
5,642,335 A * 6/1997 Taylor ..... 368/223
5,748,568 A * 5/1998 Harrison ..... 368/82
6,249,486 B1 * 6/2001 Chitturi ..... 368/21
6,711,101 B2 * 3/2004 Bornovski ..... 368/223
2006/0104160 A1 * 5/2006 Lassalle ..... 368/77

FOREIGN PATENT DOCUMENTS

CH 683664 A3 * 4/1994
DE 4135514 A1 * 2/1993
GB 0224874.8 * 10/2002 ..... 368/77

* cited by examiner

*Primary Examiner*—P. Austin Bradley
*Assistant Examiner*—Jeanne-Marguerite Goodwin
(74) *Attorney, Agent, or Firm*—Lisa M. Gehrke; Gehrke & Associates, SC

(57) ABSTRACT

A timepiece includes a display face having a color time field with a first axis representing a first unit of time and a second axis representing a second unit of time, wherein a colored section fills the color time field as time elapses and wherein a current color displayed in the colored section is one color in a set of different colors that correspond to a predetermined measurement of time.

5 Claims, 5 Drawing Sheets

COLOR TIMEPIECE

BACKGROUND OF THE INVENTION

1. Field of the Invention

The present invention relates generally to the display of time. In particular, the present invention relates to a timepiece that associates particular colors with each hour in a day and enables a person to tell time without the use of any numerical indicia.

2. Discussion of the Related Art

Although many specific improvements have been implemented in timepiece designs, these basic improvements have remained unchanged in that they generally consist of using color not as a functional part of telling time, but merely to enhance a particular design. Therefore, the use of color is primarily cosmetic and not an integral function of the timepiece.

Learning to read traditional analogue clocks can be difficult for some people. For example, it is a common mistake to confuse the minute hand with the hour hand. It is also difficult to teach children to correctly "read" the minute hand (e.g., when the minute hand is pointing to number 1, it is 5 minutes past the hour, when the minute hand is pointing to number 2, it is 10 minutes past the hour, etc.). Finally, as the minute hand approaches the 12, the hour hand moves towards the next hour, thereby making it unclear what is the current hour unless the person makes the association that it is almost the next hour because the minute hand has almost completed a full revolution around the timepiece. All of these concepts are very difficult to master for a young child and in some cases even for adults.

Rather than improving the design of analogue clocks, digital designs have replaced the traditional analogue timepieces. Digital timepieces are easy to read and reduce the time and effort required to learn how to "tell time". Children, however, often find it difficult to understand time based on a digital design because there is no visual representation of time that has past or time that is remaining in a particular hour. For example, looking at an analogue timepiece, it is easy to understand that if it is 6:15, there are 45 minutes remaining in the hour.

In other words, because the minute hand has to complete another ¾ of a revolution around the face, it does not require a lot of effort to visualize and quickly associate the position of the minute hand with a particular time based on the knowledge that one revolution around the timepiece equates to 60 minutes. On the contrary, there is no corresponding visual representation of time that is remaining in a particular hour in a digital timepiece.

What is needed, therefore, to overcome these inherent design limitations of both analogue and digital timepieces is the design of a new timepiece that utilizes specific colors that are associated with particular increments of time.

SUMMARY OF THE INVENTION

According to one aspect of the invention, a timepiece includes a display face having a first color on the face corresponding to a current predetermined measurement of time and a second color on the face corresponding to a consecutive predetermined measurement of time, wherein the second color fills the face clockwise as an interval of time elapses.

According to another aspect of the invention, a timepiece includes a display face having a color time field with a first axis representing a first unit of time and a second axis representing a second unit of time, wherein a colored section fills the color time field as time elapses and wherein a current color displayed in the colored section is one color in a set of different colors that correspond to a predetermined measurement of time.

According to yet another aspect of the invention, a method of telling time includes assigning a different color to a predetermined measurement of time, displaying on a face of a timepiece a first color corresponding to a current predetermined measurement of time and a second color corresponding to a consecutive predetermined measurement of time, wherein each of the colors are displayed sequentially in a continuous loop representing the predetermined measurements of time that elapse in the day, and filling the face of the timepiece with the second color as an interval of time elapses.

These and other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear understanding of the various advantages and features of the present invention, as well as the construction and operation of conventional components and mechanisms associated with the present invention, will become more readily apparent by referring to the exemplary, and therefore non-limiting, embodiments illustrated in the following drawings which accompany and form a part of this patent specification.

DETAILED DESCRIPTION OF THE PREFERRED EMBODIMENTS

Like the passing hours of the day, color tends to evoke a variety of human responses. A person can learn to associate specific times of the day with specific colors, just as specific times are now associated with numbers. The colors that correspond to different times may reference a variety of daily experiences (e.g., qualities of natural light, colors of the sky, ambient temperature, mood, energy, etc.).

In this regard, colors can be assigned to different measurements of time and displayed on a timepiece instead of displaying the traditional analogue or digital time. For example, a particular color can be associated with a person's workday and displayed on a timepiece or three separate colors corresponding to the morning, afternoon and evening can be displayed. In the present invention, any measurement of time including different intervals of blocks of time are assigned a particular color and a person determines a measurement of time by viewing the color on the timepiece.

Figure 1:
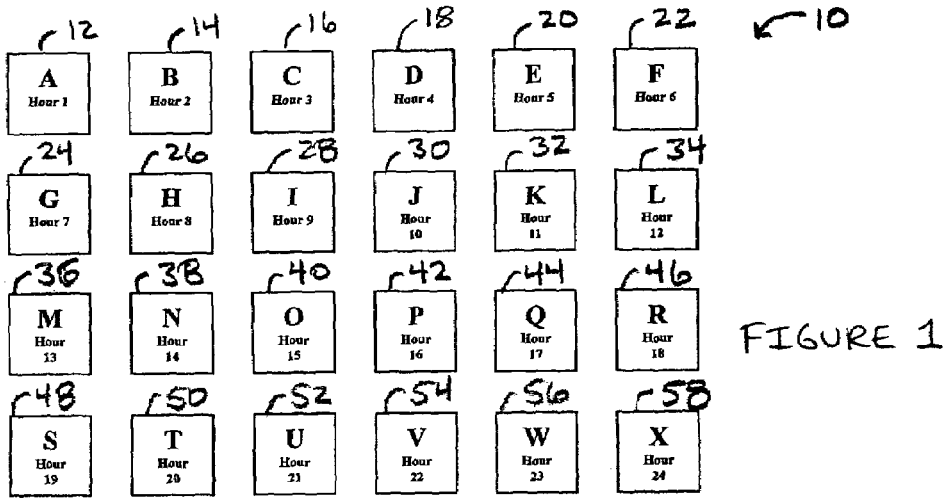
FIG. 1 illustrates a color grid corresponding to 24 different hours in a day in accordance with the present invention.

Referring now to FIG. 1, a set of colors can also be assigned to each of the hours in a day. In particular, a color grid 10 includes 24 arbitrary different colors or shades of color corresponding to the 24 different hours in a day. In the first row of the grid, color A 12 corresponds to the first hour in a day, color B 14 corresponds to the second hour in a day, color C 16 corresponds to the third hour in a day, color D 18 corresponds to the fourth hour in a day, color E 20 corresponds to the fifth hour in a day, and color F 22 corresponds to the sixth hour in a day.

Similarly, in the second row of grid 10, color G 24 corresponds to the seventh hour in a day, color H 26 corresponds to the eighth hour in a day, color I 28 corresponds to the ninth hour in a day, color J 30 corresponds to the tenth hour in a day, color K 32 corresponds to the eleventh hour in a day, and color L 34 corresponds to the twelfth hour in a day.

In the third row of grid 10, color M 36 corresponds to the thirteenth hour in a day, color N 38 corresponds to the fourteenth hour in a day, color O 40 corresponds to the fifteenth hour in a day, color P 42 corresponds to the sixteenth hour in a day, color Q 44 corresponds to the seventeenth hour in a day, and color R 46 corresponds to the eighteenth hour in a day.

Finally, in the fourth row of grid 10, color S 48 corresponds to the nineteenth hour in a day, color T 50 corresponds to the twentieth hour in a day, color U 52 corresponds to the twenty-first hour in a day, color V 54 corresponds to the twenty-second hour in a day, color W 56 corresponds to the twenty-third hour in a day, and color X 58 corresponds to the twenty-fourth hour in a day.

In addition to the 24 distinct colors described above in relation to grid 10, alternative color schemes that maintain the functional relationship between the hour and color include implementing a grid with 12 different colors having 2 different shades for each color, 6 different colors having 4 different shades for each color, and 4 different colors having 6 different shades for each color.

Figure 2:
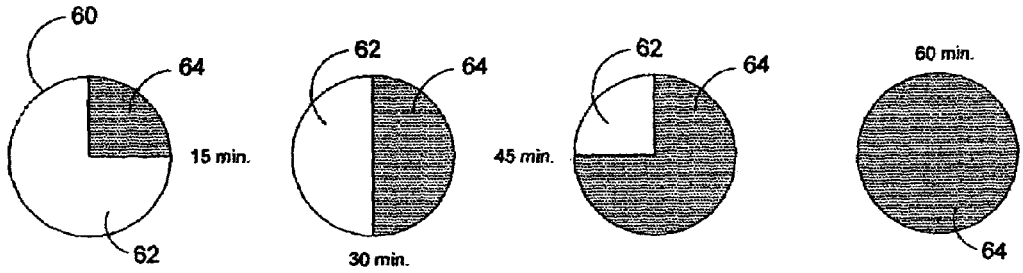
FIG. 2 illustrates an analogue dial design implementing the color grid in accordance with the present invention.

Referring to FIG. 2, an analogue dial design 60 relies upon the association of colors in color grid 10 with the hours of a day to tell time. In particular, color 62 represents the current hour, and color 64 represents the next consecutive hour. As the minutes pass, color 64 continues to fill the dial while color 62 diminishes correspondingly until the full sixty minutes in the current hour have passed and color 64 entirely fills dial 60.

Thereafter, the color that is associated with the next hour after the hour corresponding to color 64 will begin to fill the dial as the minutes pass. This process continues based on the colors associated with the particular hours as assigned in grid 10. Alternatively, dial 60 may implement a color grid associated with 12 different hours in the day and rely upon the person to determine whether the particular time of day is in the a.m. or p.m.

Figure 3:
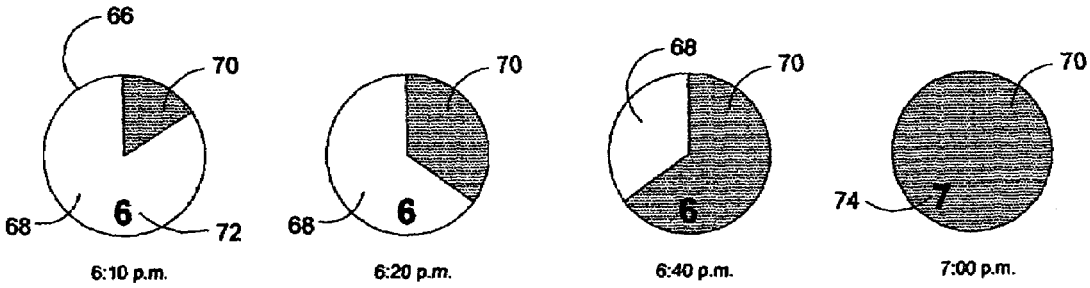
FIG. 3 illustrates an analogue dial design with a digital hour indicator implementing the color grid in accordance with the present invention.

FIG. 3 illustrates a similar dial 66 also implementing color grid 10. Dial 66 uses a color 68 to represent the current hour and a color 70 to represent the next consecutive hour. In an alternative embodiment of the present invention, dial 66 further includes a numerical indicator 72 that is displayed to assist a person in remembering the hour associated with color 68 or color 70. In this case, numerical hour indicator 72 is "6" which is associated with color 68 that represents 6:00 p.m. Another numerical hour indicator 74 is associated with color 70 that represents 7:00 p.m. Numerical indicators 72 and 74 are placed along the circumferential edge of dial 66 consistent with the traditional placement of the numbers 1-12 representing the hours on a traditional analogue watch dial.

Figure 4:
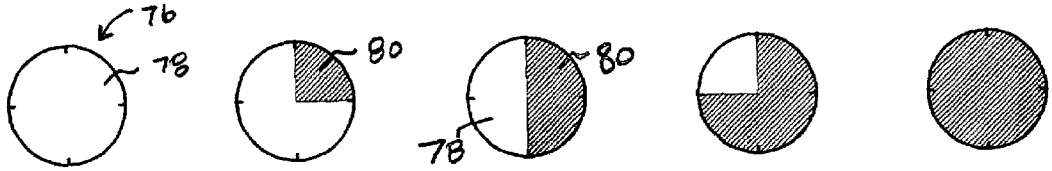
FIG. 4 illustrates a positive circular cycle to graphically display the passing of time in accordance with the present invention.

The implementation of color grid 10 does not necessarily have to be in the form of a circular dial. In this regard, FIGS. 4-9 illustrate different graphic forms to display the passing of time. In particular, FIG. 4 illustrates a circular dial 76 having a first color 78 corresponding to a particular hour and a second color 80 corresponding to the next consecutive hour. Dial 76 is positively filled by color 80 as the minutes pass.

Figure 5:
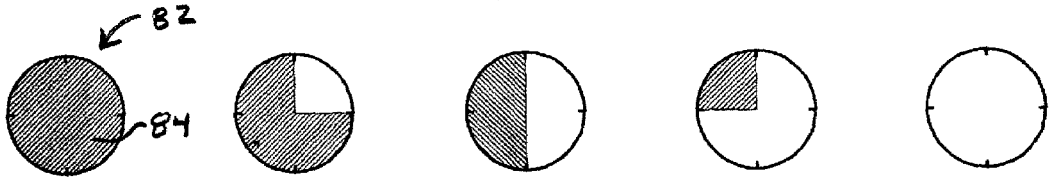
FIG. 5 illustrates a negative circular cycle to graphically display the passing of time in accordance with the present invention.
Figure 6:
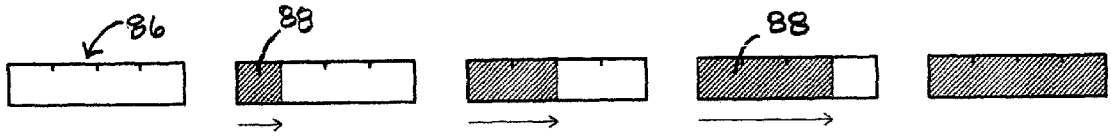
FIG. 6 illustrates a bar filling a field to graphically display the passing of time in accordance with the present invention.
Figure 7:
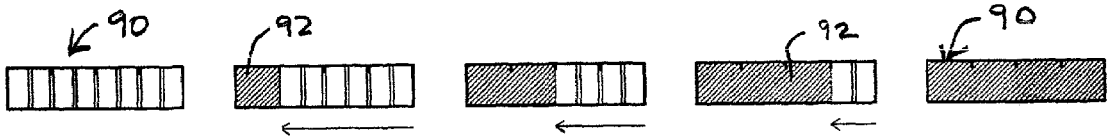
FIG. 7 illustrates a bar crossing a field and stacking to graphically display the passing of time in accordance with the present invention.

FIG. 5 illustrates a negative circular dial 82 that begins with a color 84 that gradually disappears as the minutes pass. FIG. 6 illustrates a field 86 with a bar 88 that gradually fills field 86 as time passes. Another embodiment to illustrate the passing of time is a field 90 in FIG. 7 having a bar 92 that traverses across field 90.

Figure 8:
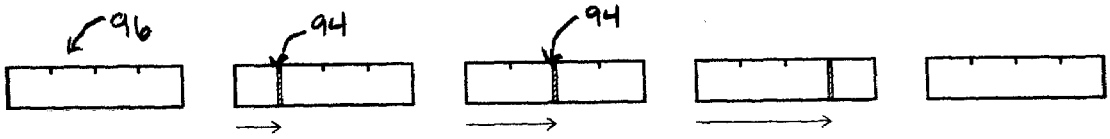
FIG. 8 illustrates a line crossing a field to graphically display the passing of time in accordance with the present invention.
Figure 9:
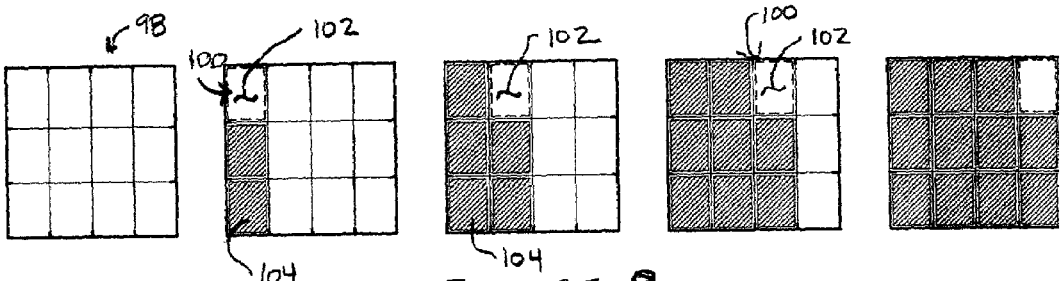
FIG. 9 illustrates objects flashing in a field and successively filling a field to graphically display the passing of time in accordance with the present invention.

FIG. 8 illustrates a line 94 in a field 96 that moves across field 96 as time passes. FIG. 9 illustrates a grid 98 with an object 100 that flashes in a field 102 in grid 98. Each successive field is filled with a color 104 as time passes.

Figure 10:
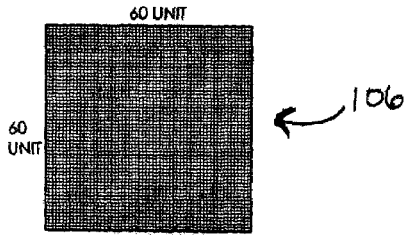
FIG. 10 illustrates a basic color time field in accordance with the present invention.

FIG. 10 illustrates the use of color grid 10 implemented in a basic color time field. There are 60 seconds in a minute and 60 minutes in an hour. Therefore, a 60 unit×60 unit grid 106 has 3,600 units and provides the basic color time field in the preferred embodiment of the present invention.

Figure 11:
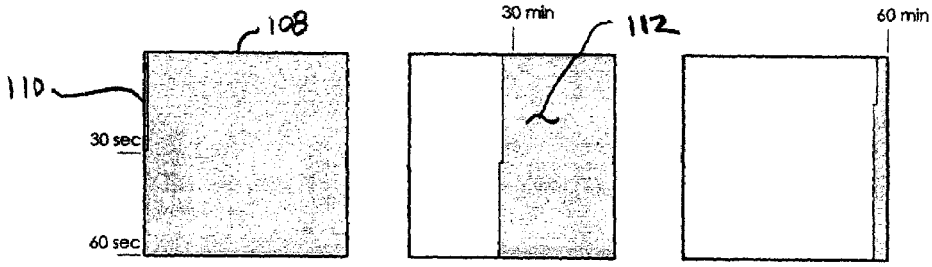
FIG. 11 illustrates the passing of time using a basic color time field in accordance with the present invention.

As illustrated in FIG. 11, minutes of time are represented by a horizontal axis 108 and seconds of time are represented by a vertical axis 110. A person can easily see the passing of both seconds and minutes using grid 106 by viewing the consecutive filling of each of the 3,600 units in every hour. Moreover, the specific color that fills grid 106 corresponds to a particular hour represented on color grid 10. Therefore, a person can easily determine the exact hour, minute and second (e.g., accurately tell time) displayed on grid 106 by entirely relying upon color instead of numerical indicia.

In operation, a color 112 corresponding to a particular hour on grid 10 fills color time field 106 over the course of an hour. After the hour is completed by filling each second and minute in color time field 106, then the next consecutive color in color grid 10 representing the next successive hour begins to fill each of the 3,600 units in grid 106. This process continues in a repeating 24 color loop corresponding to the hours in a day.

Figure 12:
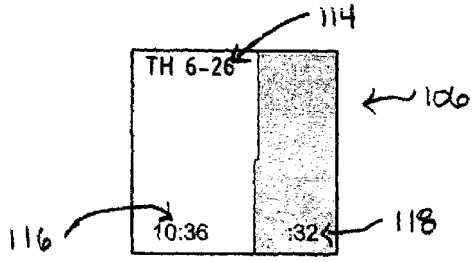
FIG. 12 illustrates a digital display of time using a basic color time field in accordance with an alternative embodiment of the present invention.

In an alternative embodiment of the present invention, FIG. 12 illustrates color time field 106 having external indicia also representing the time. A date indicator 114 displays the day of the week, month and date. A time indicator 116 displays the hour and minutes and a second indicator 118 displays the elapsed seconds. Digital indicia 114, 116 and 118 may be turned on and off by a person and is used primarily to assist the user in learning the association of specific colors with specific hours as represented in grid 10.

Figure 13:
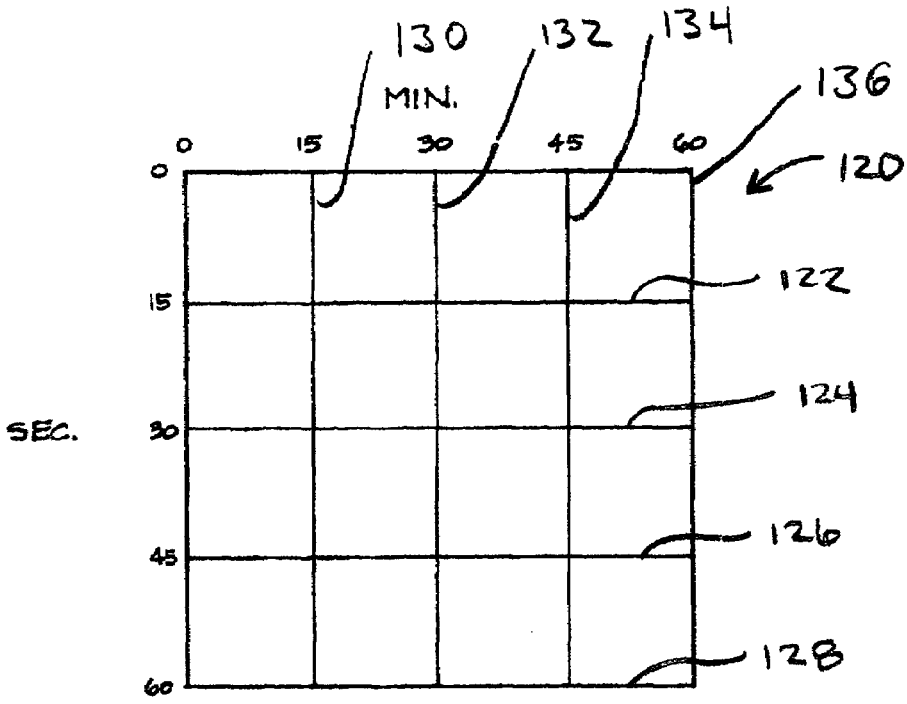
FIG. 13 illustrates a basic color time field with grid lines in accordance with the present invention.
Figure 14:
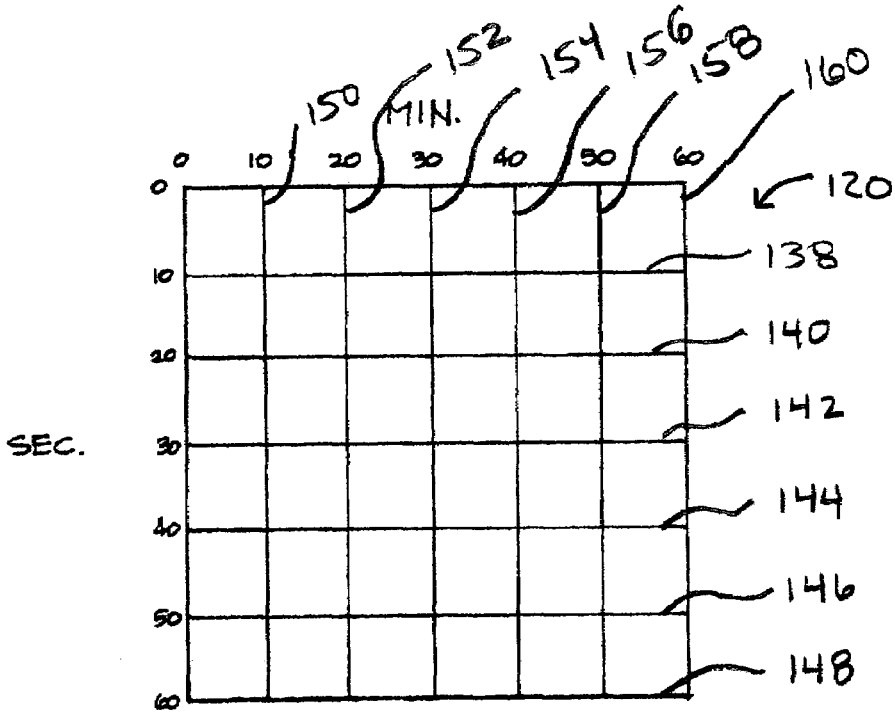
FIG. 14 illustrates a basic color time field with grid lines in accordance with the present invention.

As illustrated in FIGS. 13 and 14, a reference grid 120 can be displayed in color time field 106 to assist a person in telling time more accurately. For example, in FIG. 13, a set of horizontal reference lines 122, 124, 126 and 128 correspond to elapsed time of 15 seconds, 30 seconds, 45 seconds and 60 seconds, respectively. A set of vertical reference lines 130, 132, 134, and 136 corresponds to elapsed time of 15 minutes, 30 minutes, 45 minutes and 60 minutes, respectively.

Similarly, a set of reference lines 138, 140, 142, 144, 146 and 148 correspond to elapsed time of 10 minutes, 20 minutes, 30 minutes, 40 minutes, 50 minutes and 60 minutes, respectively. A set of reference lines 150, 152, 154, 156, 158 and 160 corresponds to elapsed time of 10 minutes, 20 minutes, 30 minutes, 40 minutes, 50 minutes and 60 minutes, respectively.

Figure 15:
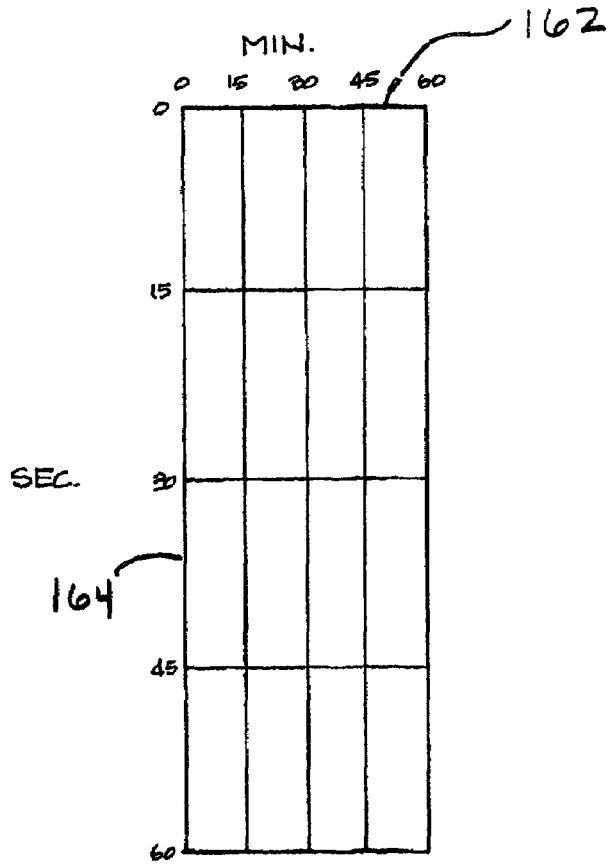
FIG. 15 illustrates a basic color time field stretched in a vertical direction in accordance with the present invention.
Figure 16:
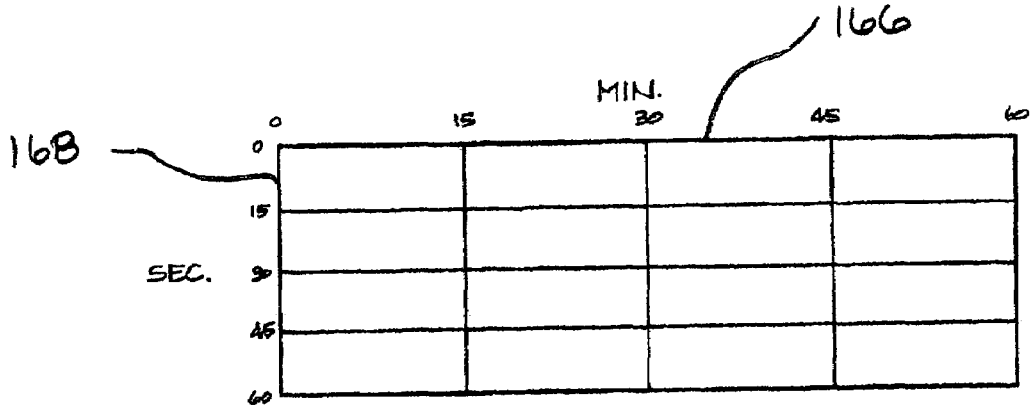
FIG. 16 illustrates a basic color time field stretched in a horizontal direction in accordance with the present invention.

Color time field 106 can also be stretched to accommodate different shapes of different timepieces. For example, as illustrated in FIG. 15, the length of an axis 162 representing the minutes is substantially less than the length of an axis 164 representing the seconds. In FIG. 16, however, the length of an axis 166 representing the minutes is substantially greater than the length of an axis 168 representing the seconds. By stretching and contracting the axes representing the seconds and minutes across color time field 106, color grid 10 can be implemented in a variety of different shapes of timepieces.

The scope of the application is not to be limited by the description of the preferred embodiments described above, but is to be limited solely by the scope of the claims that follow. For example, color time field 106 can be replaced with a circular design or any other geometric design without departing from the scope of the preferred embodiment of the present invention.

What is claimed is:

1. A timepiece comprising:

a display face including a color time field having a first horizontal axis representing a first unit of time and a second vertical axis representing a second unit of time, wherein the first unit of time and the second unit of time are minutes or seconds, wherein a colored section fills the color time field as time elapses and wherein a current color displayed in the colored section is one color in a set of 24 different colors, each of which corresponds to a different hour in a day.

2. A timepiece comprising:

a display face including a color time field having a first horizontal axis representing a first unit of time and a second vertical axis representing a second unit of time, wherein the first unit of time and the second unit of time are minutes or seconds, wherein a colored section fills the color time field as time elapses and wherein a current color displayed in the colored section is one color in a set of 12 different colors, each of which corresponds to a different hour in half a day.

3. A timepiece comprising:

a display face including a color time field having a first horizontal axis which advances with each passing minute and a second vertical axis which advances with each passing second and, wherein the color time field is a 60 unit ×60 unit grid having a set of 3,600 units, wherein a next color in the set of colors corresponding to a next consecutive hour begins to fill the color time field after the current color in the colored section representing a current hour has filled each of the 3,600 units in the grid.

4. A timepiece according to claim 3, further comprising a first set of indicia along the first axis marking intervals of the first unit of time and a second set of indicia along the second axis marking intervals of the second unit of time.

5. The timepiece according to claim 4, wherein the length of the first axis is substantially different than the length of the second axis.

* * * * *